US005402042A

United States Patent [19]

Madsen

[11] Patent Number: 5,402,042

[45] Date of Patent: Mar. 28, 1995

[54] METHOD AND APPARATUS FOR VACUUM FLUORESCENT DISPLAY POWER SUPPLY

[75] Inventor: Wayne A. Madsen, Kokomo, Ind.

[73] Assignee: Delco Electronics Corporation, Kokomo, Ind.

[21] Appl. No.: 149,400

[22] Filed: Nov. 9, 1993

[51] Int. Cl.[6] ..... H05B 35/00

[52] U.S. Cl. ..... 315/174; 315/169.1; 315/169.3; 315/307; 315/105; 315/209 R

[58] Field of Search ..... 315/169.1, 169.3, 349, 315/350, 105, 209 R, 291, 174, 307

[56] References Cited

U.S. PATENT DOCUMENTS 3,515,938 6/1970 Morse ..... 315/165

4,495,445 1/1985 Turney ..... 315/169.5

*Primary Examiner*—Robert J. Pascal

*Assistant Examiner*—Reginald A. Ratliff

*Attorney, Agent, or Firm*—Jimmy L. Funke

[57] ABSTRACT

A power supply for a VF display generates a DC filament voltage from a battery by either a switched transformer supply or a monolithic regulator circuit. Where a higher-than-battery voltage is needed for anode and grid voltages, another monolithic regulator circuit or the switched transformer is used. An H-switch develops an alternating voltage from the DC voltage and applies it to the display filament. A controller for the H-switch is a logic circuit including flip-flops which toggle in response to a low frequency pulsed dimmer signal to synchronize the filament half cycles with the dimmer phases. Slew rate control ramps the H-switch control signal to produce a trapezoidal waveform in the filament current having reduced radio frequency emissions.

15 Claims, 3 Drawing Sheets

METHOD AND APPARATUS FOR VACUUM FLUORESCENT DISPLAY POWER SUPPLY

FIELD OF THE INVENTION

This invention relates to power supplies and particularly to a method and apparatus for providing regulated voltage to a vacuum fluorescent display for systems using DC power sources.

BACKGROUND OF THE INVENTION

Vacuum fluorescent (VF) displays require a filament power supply to heat the filament to a temperature suitable for proper emission of electrons which are accelerated by an anode potential onto a fluorescent material to emit light. In VF displays which are physically short (up to about three inches) a DC filament voltage of typically less than three volts can be used. The gradient in filament to anode voltage over the length of the tube can be compensated for by physically varying the filament to anode spacing over the length of the tube. In this case, a simple dropping resistor from the power source (usually a 12 V battery in automotive applications) can be used. However, variations in battery voltage will cause variations in the filament voltage and thus light intensity.

In longer VF displays where higher filament voltages are required, an AC filament must be employed, so that the filament to anode voltage gradient reverses periodically (and rapidly enough to avoid producing any apparent flicker), resulting in a more uniform intensity over the length of the VF tube. In simple displays which can use battery voltage for the anode power supply, a sine-wave filament supply is typically used. Usually a transformer is used with a resonant primary circuit and a push-pull transistor drive arrangement. The resulting sine-wave output voltage (typically at 30 kHz) is proportional to the battery source voltage. A filament synch signal is required when the display is dimmed using pulse width modulation, insuring that the dimming pulse is actuated on opposite phases of the filament waveform to eliminate beating between the filament and dimming frequencies which would result in flickering of the display.

In more complicated displays using higher-than-battery voltages for the grid and anode supplies, generally a switching flyback power supply circuit is employed. This also requires a transformer, but can provide multiple output voltages. One of the regulated DC outputs can be used to power a sine-wave filament supply as described above, but this requires an additional transformer. Alternatively, an additional winding can be added to the flyback transformer to provide the filament voltage directly. This approach, however, yields a very non-sinusoidal output waveform. At switching frequencies of 50 kHz or greater, the harmonic content is significant, especially in the AM broadcast band, resulting in objectionable radio frequency interference (RFI). Filtering of the output waveform is possible, but adds extra components and cost. Also, when the filament power supply is powered from the output of the switching power supply, all the power for the filament in addition to the transformer, must be converted through the switching transistor and transformer, dissipating significant amounts of power and usually requiring a heat sink and larger transformer, capacitors and diodes. A filament synchronization signal is typically derived from the filament AC power supply and connected to the circuit controlling the pulse width modulated (PWM) dimming of the display.

The use of transformers requires some hand assembly of components during fabrication and result in large, relatively heavy power supplies. Due to power conversion inefficiencies, heat generation results in the need for heat sinks.

Thus in existing systems which use battery voltage for the anodes and grids of VF displays, the filament power supply is generally a sine-wave type. The operating frequency is typically about 30 kHz to reduce the size of the transformer and resonating capacitor. This supply is basically unregulated when its source voltage is directly from the battery. A filament synchronization signal is required to reduce flicker at low duty cycle dimming values. The center-tapped output winding of this configuration can easily be referenced to ground, or biased above ground to provide a higher voltage to facilitate cutoff, if required for the VF display tube. In systems which use a switching power supply to provide higher voltages for anode voltage, a separate filament transformer is excited from the secondary of the switching power supply. Sine wave filament power sources also yield a high frequency voltage with harmonics which result in RF interference, especially in the AM band.

SUMMARY OF THE INVENTION

The proposed filament supply configuration uses a step-down switching regulator, containing a very simple monolithic regulator using a single inductor with associated circuitry, and an H-switch driver with a control and sequencing circuit to provide an AC trapezoidal filament waveform. The output voltage of this supply is regulated, independent of battery voltage. The filament waveform can be synchronized automatically and directly from the dimming signal, eliminating the extra filament synch signal and processing required to accommodate it. For systems requiring higher-than-battery voltage, a simple step-up switching regulator using another monolithic regulator is added to the circuit.

Large and costly transformers are not necessary and all components can generally be placed on the circuit board with automatic equipment. This configuration results in the low side of the waveform connected to ground, providing an RMS filament voltage biased at roughly half the DC voltage, but it is possible to easily increase the bias voltage if necessary (such as by inserting a diode or two in series with the ground connection of the H-switch driver). Due to the low frequency of operation, the transitions of the filament waveform (slew rate) can be slow enough to produce very low levels of radiated RF emissions.

The power supply does not necessarily require monolithic regulators. Much of the advantage is retained even if the switching transformer is used for the regulation due to the trapezoidal waveform. The H-switch arrangement is not the exclusive means for producing the desired trapezoidal waveform. For example, an operational amplifier circuit with integrating capacitors is also useful for switching and providing the desired slew rate.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE INVENTION

Figure 1:
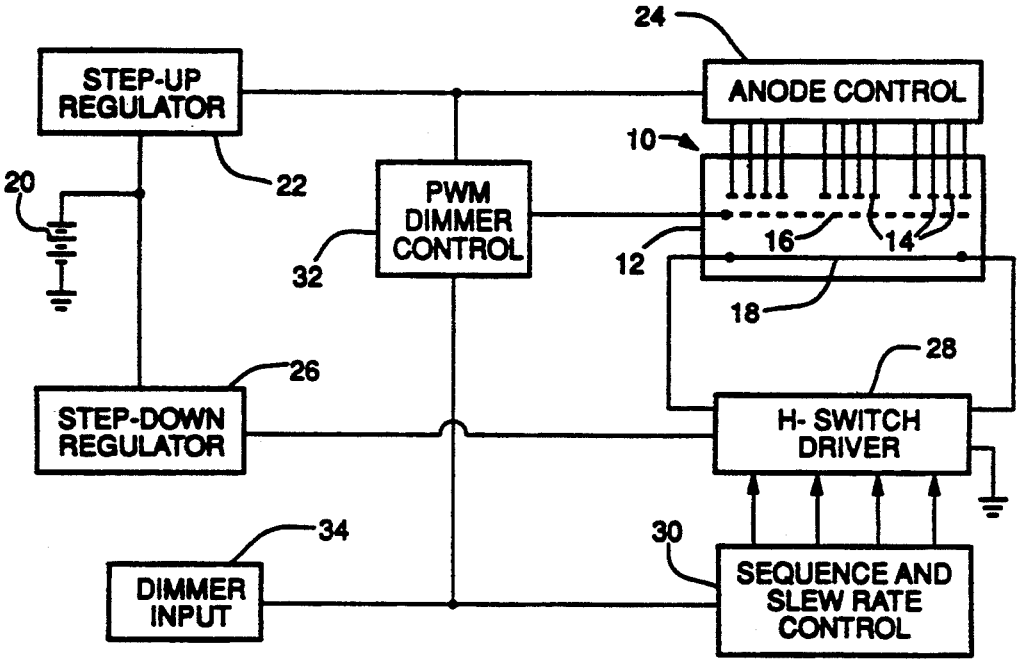
FIG. 1 is a schematic diagram of a VF display and its power supply according to the invention.

FIG. 1 illustrates a typical vacuum fluorescent display 10 and attendant power and control circuitry. The VF display 10 comprises a tube or envelope 12 containing a plurality of anodes 14, a grid 16 and a filament 18. As is well known, the filament 18 is a thin tungsten wire coated with an oxide material for the thermal emission of electrons when the wire is sufficiently heated. The grid 16 is an electrode which controls the thermal electrons emitted from the filament. It is positioned between the filament 18 and the anode 14. When the grid 16 is positive relative to the filament, electrons from the filament are accelerated toward the anode. The anode is comprised of conductive elements coated with a phosphor in a desired pattern. When the grid and the anode elements are positive, the thermal electrons collide with the phosphor to cause light emission. Thus by controlling the voltage on the anode elements and grid, the anode elements may be selectively illuminated. To assure that there is no light emission when not desired, an anode element (for selective control) or grid (for controlling all anode elements) is impressed with a voltage below a cutoff level, which may be the filament voltage or lower. In some cases a positive bias voltage is applied to the filament to assure that a ground voltage on the grid or anode is sufficient to stop light emission.

In case it is desired to dim the display rather than turn it off, the grid voltage may be applied by pulse width modulation thereby controlling emission on a duty cycle basis. The voltage on the grid is thus pulsed at a fixed frequency determined by the dimmer signal, the pulses having a voltage which may, for example, be the same as the anode voltage.

The power and control circuitry is shown for the case of a display requiring a voltage higher than battery voltage for the anode and grid. The battery 20 is connected to a step-up regulator 22 which supplies a regulated voltage for the anode 14. An anode control circuit 24 selectively switches the anode voltage to the anode elements. A step-down regulator 26, connected to the battery 20, supplies a regulated voltage lower than battery voltage to the filament 18 through an H-switch driver 28. Each such regulator 22, 26 preferably comprises a monolithic circuit and an attendant circuit having a simple inductor. No transformer is required. The monolithic regulator circuits are, for example, a step-up voltage regulator LM1577-ADJ, and step-down voltage regulator LM2576-ADJ, both available from National Semiconductor Corporation.

The driver 28 is referenced to ground so that the regulated voltage is applied to one end of the filament while the other end is grounded. If desired, a positive bias may be used as a reference potential instead of ground, thereby raising the average filament voltage to increase the cutoff bias voltage. The driver 28 is operated by a sequence and slew rate control 30. A pulse width modulated dimmer control 32 couples the anode voltage from the regulator 22 to the grid 16 on a duty cycle basis. The dimmer control 32 is responsive to a pwm dimmer signal from a dimmer input 34, which may be manually or automatically controlled to select the display brightness. The same signal is employed by the sequence control 30 to trigger switching of filament current in concert with the grid voltage pulses. As will be seen, the switching of filament current reverses the current direction, so that two trigger pulses are required for each filament current period. The resulting halved frequency results in equal and opposite phases of the waveform being applied on alternate dimming pulses, yielding automatic filament synchronization. Other signal sources could be used as well, including microprocessor drive or other frequencies available in the system. This configuration provides a regulated RMS filament voltage. It should be noted that the sinking transistors of the H-switch must conduct both the filament current as well as the anode and grid currents. It should also be noted that while the automatic filament synchronization works well for a non-multiplexed display, there are some multiplex applications where another phasing scheme is required.

Figure 2:
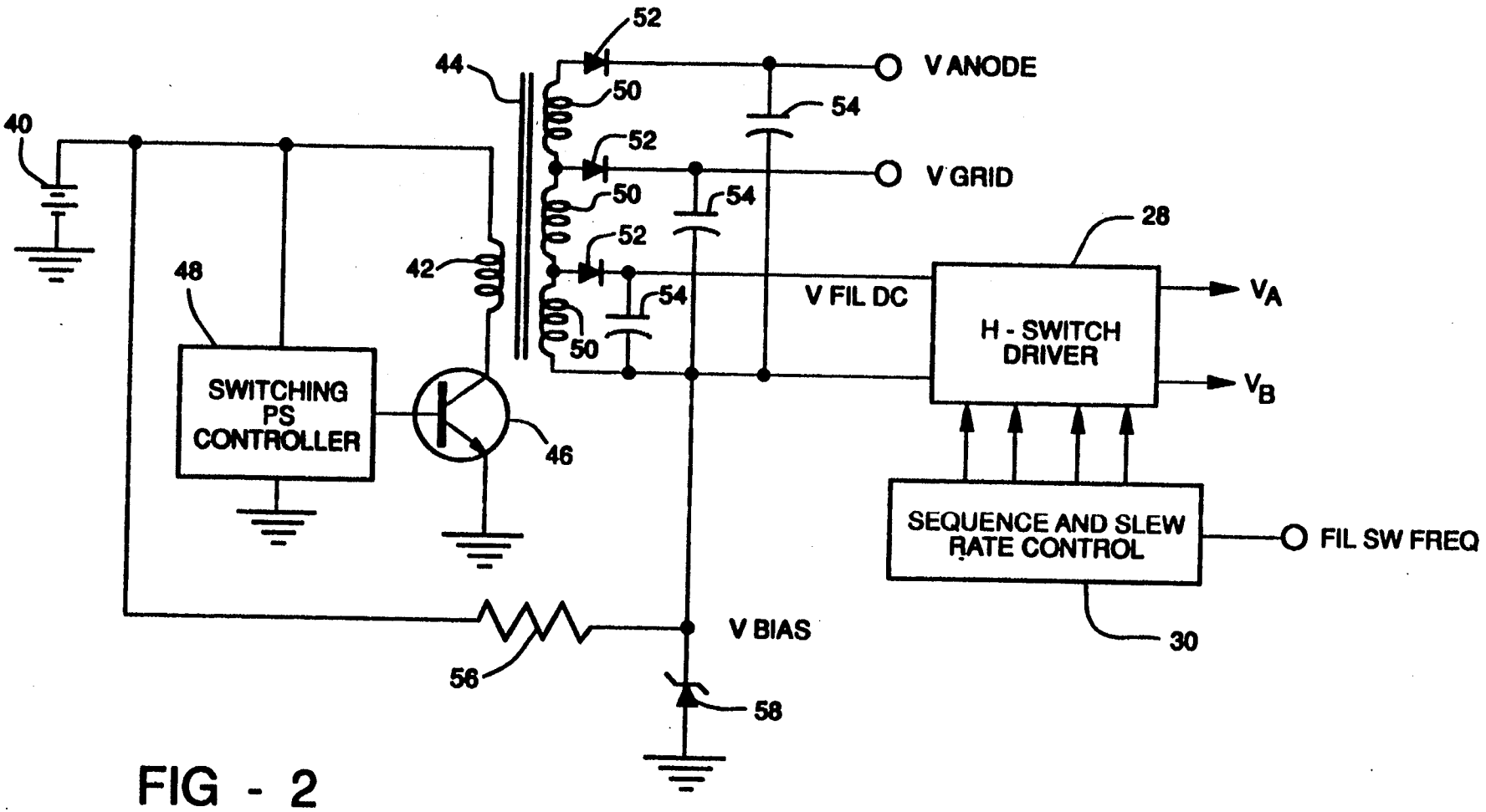
FIG. 2 is a schematic diagram of a VF power supply according to another embodiment of the invention.

A configuration simpler than that of FIG. 1 uses battery voltage for the anode and grid voltage. The remainder of the circuit which supplies filament voltage would be unchanged. Similarly, even if a transformer is used to provide the anode, grid and filament DC voltages, the same arrangement using the H-switch driver 28 and the sequence and slew rate control 30 can be used to supply the AC filament current. That arrangement is shown in FIG. 2 where a battery 40 supplies the primary winding 42 of a flyback transformer 44. The transformer 44 is controlled by a transistor switch 46 in series with the primary winding 42 and the transistor switch, in turn, is controlled by a switching controller 48. The transformer secondary windings 50 are coupled via rectifying diodes 52 to smoothing capacitors 54 to provide separate anode and grid voltages as well as a DC filament voltage, each at desired levels. The DC output voltages are referenced to a bias voltage derived from the junction of a dropping resistor 56 and a Zener diode 58 serially connected across the battery 40. In some cases a ground reference voltage is preferred to the positive bias. The bias voltage and the DC filament voltage are applied to the H-switch 28 controlled by a sequence and slew rate controller 30 like that of FIG. 1 to produce on outputs $V_A$ and $V_B$ an alternating waveform for the filament.

Figure 3:
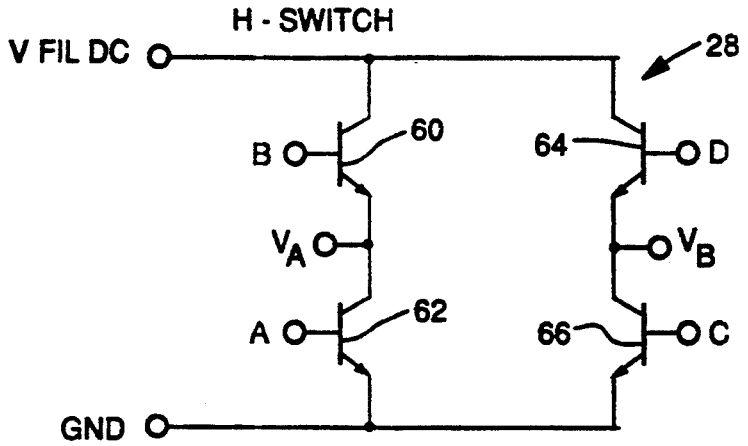
FIG. 3 is a schematic diagram of an H-switch circuit for use in either embodiment of the invention.

The H-switch is shown in FIG. 3. The switch comprises two legs connected between the DC filament voltage and ground. The first leg comprises a first transistor 60 connected from the DC filament voltage to the output VA, and a second transistor 62 between that output and ground. The second leg comprises a third transistor 64 connected from the DC filament voltage to the output $V_B$, and a fourth transistor 66 between that output and ground. The output $V_A$ is connected to one end of the filament and the output $V_B$ is connected to the other end. The H-switch 28 is controlled so that transistors 60 and 66 conduct to apply the DC voltage to the output $V_A$ and ground to the output $V_B$ for one half period, and then to turn them off and turn on transistors 54 and 62 to reverse the voltages on the outputs for the next half period, thereby applying alternating voltage to the filament. Control voltages A, B, C and D are applied to the bases of transistors 62, 60, 66 and 64, respectively, by the sequencing control 30.

Figure 4:
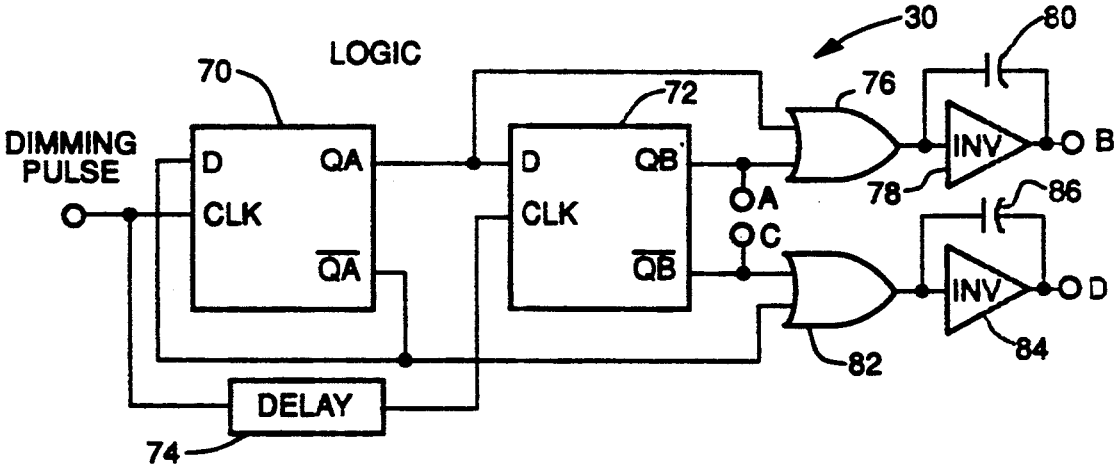
FIG. 4 is a schematic diagram of a control circuit for the H-switch of FIG. 3.

FIG. 4 shows the sequence and slew rate control 30 which uses a toggle action of a pair of D flip-flops to control the transistor base voltages A, B, C and D. The flip-flop 70 has its clock input coupled to the dimming pulse from the dimmer input 34 and its data input connected to the inverted QA output so that the outputs QA and inverted QA toggle upon receipt of the rising edge of each dimming pulse. The second flip-flop 72 has its clock input coupled through a delay circuit 74 to the dimming pulse. The data input is coupled to the QA output of flip-flop 70. The output QB is the control signal A and is input to an OR gate 76. The output QA is a second input to the OR gate. The output of the OR gate 76 is fed to an inverting amplifier 78 which has as its output the control signal B. A capacitor 80 across the amplifier 78 causes the signal B to change slowly when its input switches, thus providing a slew rate control for transistor 60 upon turning on as well as upon turning off. The capacitor is selected to allow the signal B to effectively reach its steady state value within the time delay set by the delay circuit 74. The output inverted QB is the control signal C and is input to an OR gate 82. The output inverted QA is a second input to the OR gate 82. The output of the OR gate 82 is fed to an inverting amplifier 84 which has as its output the control signal D. A capacitor 86 across the amplifier 84 provides a slew rate to the signal D like that afforded for the signal B.

Figure 5:
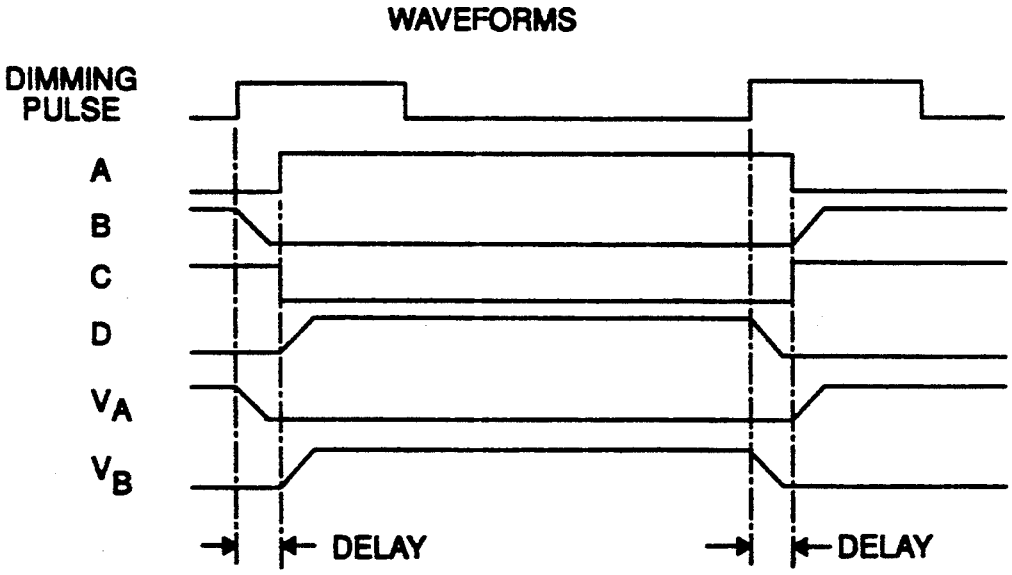
FIG. 5 is a set of waveforms generated by the circuit according to the invention.

The operation of the sequencing circuit 30 is best understood with reference to the signal waveforms shown in FIG. 5. Assuming that the control signals B and C are initially high and signals A and D are low, transistors 60 and 66 will be conductive so that the filament voltage $V_A$ will be high and $V_B$ will be low. In that case, QA and QB will be low and inverted QA and inverted QB will be high. Then upon the rising edge of the dimming pulse the flip-flop 70 will toggle to reverse its output states causing the OR gate 76 output to go high and the signal B and the voltage $V_A$ to decrease at a slew rate set by the capacitor 80. When the delay time of circuit 74 expires the flip-flop 72 outputs change state so that signal A quickly goes high, signal C quickly goes low, and signal D and voltage $V_B$ gradually increase at the slew rate to complete the switch action. Upon receipt of the next dimming pulse, the reverse action takes place to return the signal levels to the initial states. In each case where the high signal B or D goes low gradually, the low level is reached before the delay time expires, thereby assuring that there is no overlap of conduction of two transistors in the same leg. Due to the gradual increase and decrease of the signal level at the ends of each half-period and the constant intermediate value, the filament voltage and current waveform is trapezoidal. It will be recognized that the bipolar transistor circuit described here is one possible embodiment. Other equivalent circuits include the use of field effect transistors or integrated circuit H-switch drivers. An alternate circuit can be used instead of the H-switch circuit wherein operational amplifiers, driven by a sequencer, have feedback capacitors which provide the slew rate; then the sequencer would not have the slew rate function. Such an operational amplifier circuit is best suited for a low current application.

Thus the filament current is produced by generating a dc filament voltage from the battery voltage, generating a trapezoidal waveform by producing a reference voltage which may be ground or a positive bias, gradually coupling the filament voltage to the filament at one end according to a slew rate while applying the reference voltage to the other end, then maintaining a constant voltage and finally gradually removing it from that end of the filament, and repeating these steps with the polarity reversed.

Figure 6:
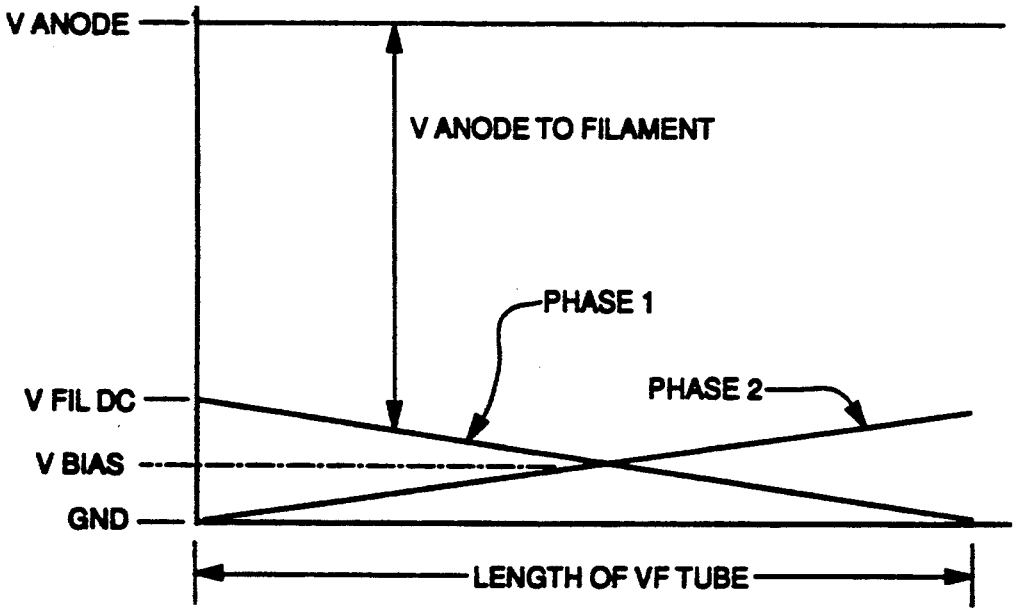
FIG. 6 is a diagram of anode and filament voltages as produced according to the invention.

FIG. 6 illustrates the voltages developed on the anode and the filament during the steady state of each half-cycle and shows the variation of filament voltage along the length of the VF tube. During one half-cycle or phase, the voltage at one end of the filament is at the level of the DC filament voltage and drops linearly toward the other end which is at ground potential. The opposite voltages occur during the other phase. At any given moment the variation of the anode-to-filament voltage causes a similar variation in display intensity, but on average the voltage and the intensity will be uniform across the tube. The average voltage V-bias serves as the cutoff bias voltage for grid or anode potential. The cutoff bias voltage and the average filament voltage is increased when a positive filament bias instead of ground is used as the reference voltage.

Since there is no filament transformer which requires high frequency, the only frequency requirement is that the frequency be high enough to prevent apparent flicker. Thus the periods of filament current can be relatively long, allowing time for a low slew rate during switching. The low slew rate helps to minimize RF emissions from the filament current which cause radio interference. Also, with this very low frequency operation, the H-switch transistors are in the linear region for a very small percentage of a period, thus maintaining high efficiency.

It will thus be seen that the improved filament power supply affords a transformerless circuit offering low frequency filament current, slew rate control to minimize RF emissions, improved efficiency, easier assembly by machine due to automatically insertable components, inherent filament synchronization, and inherent bias voltage for cutoff. Further there is independent regulation of filament and anode voltages.

The embodiments of the power supply in which an exclusive property or privilege is claimed are defined as follows:

1. In a vacuum fluorescent display having an anode, a grid and a filament, the filament having two ends for connection to a power supply, a power supply for providing suitable filament voltage from a battery comprising:

a regulator coupled to the battery for producing a DC voltage for anode and grid excitation and a DC filament voltage for filament excitation;

a switching circuit connected to the filament ends and to the regulator for applying the filament voltage in alternate directions across the filament, thereby producing an alternating current in the filament; and a control for operating the switching circuit to effect the switching at a desired frequency.

2. The power supply as defined in claim 1 wherein the control includes a source producing a pulsed signal, whereby the switching is effected at a rate determined by the pulsed signal.

3. The power supply as defined in claim 1 wherein the control includes means for switching the filament current at a controlled slew rate.

4. The power supply as defined in claim 1 wherein the switching circuit comprises an H-switch having inputs supplied by the filament voltage and a reference voltage and two outputs each connected to an end of the filament, whereby the filament voltage and the reference voltage are alternately applied to the outputs.

5. In a vacuum fluorescent display having an anode, a grid and a filament, the filament having two ends for connection to a power supply, a power supply for providing suitable filament voltage from a battery comprising:

a regulator coupled to the battery for producing a DC filament voltage for filament excitation and a reference voltage;

an H-switch connected to the regulator and having two inputs respectively supplied by the filament voltage and the reference voltage and two outputs each connected to an end of the filament, thereby producing an alternating current in the filament; and a control for operating the H-switch to effect the switching at a desired frequency.

6. The power supply as defined in claim 5 wherein the reference voltage is ground.

7. The power supply as defined in claim 5 further including means for generating a pulsed dimming signal; and wherein the control effects switching in response to the pulsed dimming signal, whereby the switching is effected at a rate determined by the pulsed signal.

8. The power supply as defined in claim 5 further including means for generating a pulsed dimming signal; and the control comprises a toggle circuit which effects switching of the H-switch in response to the pulsed dimming signal, whereby the switching of the filament current is effected at half the frequency of the pulsed signal.

9. The power supply as defined in claim 5 wherein the control includes means for effecting a trapezoidal filament current waveform by switching the filament current at a controlled slew rate.

10. The power supply as defined in claim 5 wherein the regulator comprises a step-down switching regulator having a monolithic circuit and a single inductor, whereby the filament voltage is regulated independently of battery voltage.

11. The power supply as defined in claim 5 wherein the regulator further supplies a second DC voltage higher than battery voltage for anode and grid excitation wherein the regulator comprises:

a step-up switching regulator containing a monolithic regulator using a single inductor for producing the second DC voltage; and a step-down switching regulator having a monolithic circuit and a single inductor, whereby the filament voltage is regulated independent of battery voltage.

12. In a vacuum fluorescent display having an anode, a grid and a filament, the filament having two ends for connection to two corresponding outputs of a power supply, and a battery power source, a method of supplying AC current to the filament comprising the steps of:

generating from the battery a regulated DC filament voltage;

generating from the DC filament voltage a trapezoidal AC waveform; and applying the trapezoidal AC waveform across the filament to generate a trapezoidal waveform filament current.

13. The method of supplying AC current to the filament as defined in claim 12 wherein the step of generating a trapezoidal AC waveform comprises;

producing a reference voltage;

gradually coupling the filament voltage to one end of the filament at a determined slew rate, maintaining the full filament voltage for a time and then gradually removing the voltage from the filament at the slew rate, while maintaining the other end of the filament at the reference voltage; and then gradually coupling the filament voltage to the other end of the filament at a determined slew rate, maintaining the full filament voltage for a time and then gradually removing the voltage from the filament at the slew rate, while maintaining the one end of the filament at the reference voltage.

14. The method of supplying AC current to the filament as defined in claim 12 including the step of minimizing radio frequency interference from the display by operating the AC waveform at a low frequency just high enough to avoid display flicker and changing the voltage of the trapezoidal waveform at a low slew rate to minimize the generation of radio frequency interference.

15. The method as defined in claim 12 wherein the step of generating a trapezoidal AC waveform comprises the steps of:

applying and removing the DC filament voltage across the power supply outputs with opposite polarity in succesive half-cycles to produce an AC waveform; and limiting the rate of applying and removing the voltage to a determined slew rate, whereby the emission of radio frequency interference is limited.

* * * * *